US005365312A

United States Patent [19]

Hillmann et al.

[11] Patent Number: 5,365,312

[45] Date of Patent: Nov. 15, 1994

[54] ARRANGEMENT FOR PRINTER EQUIPMENT FOR MONITORING RESERVOIRS THAT CONTAIN PRINTING MEDIUM

[75] Inventors: Rüdiger Hillmann, Emmering; Thomas Fuchs, Munich, both of Germany

[73] Assignee: Mannesmann AG, Erlangen, Germany

[21] Appl. No.: 646,777

[22] PCT Filed: Jul. 25, 1988

[86] PCT No.: PCT/DE88/00462

§ 371 Date: Jan. 22, 1991

§ 102(e) Date: Jan. 22, 1991

[87] PCT Pub. No.: WO90/00974

PCT Pub. Date: Feb. 8, 1990

[51] Int. Cl.[5] ..... G03G 15/00; B41J 27/00; B41J 32/00

[52] U.S. Cl. ..... 355/206; 355/260; 101/336; 400/207; 400/249; 347/86

[58] Field of Search ..... 355/206, 260, 308, 203; 346/140 R; 101/336; 400/191, 207, 247, 249, 613, 624; 377/15, 16, 20

[56] References Cited

U.S. PATENT DOCUMENTS

| | | | |
|---|---|---|---|
| 4,202,267 | 5/1980 | Heinzl et al. | 101/364 |
| 4,253,103 | 2/1981 | Heinzl et al. | 346/140 R |
| 4,491,430 | 1/1985 | Kuelzer | 400/208 |
| 4,797,018 | 1/1989 | Hofmann et al. | 400/249 |
| 4,851,875 | 7/1989 | Tanimoto | 355/308 X |

FOREIGN PATENT DOCUMENTS

| | | | |
|---|---|---|---|
| 0086061 | 8/1983 | European Pat. Off. . | |
| 3214548C1 | 4/1982 | Germany . | |
| 3405164A1 | 8/1985 | Germany . | |
| 59-61854 | 4/1984 | Japan | 355/206 |

*Primary Examiner*—Joan H. Pendegrass
*Attorney, Agent, or Firm*—Hill, Steadman & Simpson

[57] ABSTRACT

Reservoirs (11, 12) for printing equipment whether they are ink reservoirs, inked ribbon cassettes or toner reservoirs comprise an electronic memory means (14) in the form of a chip in which information about the current fill status of the reservoir and/or other status data, for example expiration date of the printing medium, that are relevant for the printer operation are stored. The used status of printing medium is acquired via the central controller (16) of the printing equipment and is communicated to the chip (14). The chip at the reservoir counts consumption until the supply of printing medium (ink fluid, inked ribbon, toner) exhausted to such an extent that the reservoir must be replaced. A reprogramming of the chip and, thus refilling of the reservoir is not possible.

10 Claims, 1 Drawing Sheet

Figure 1:
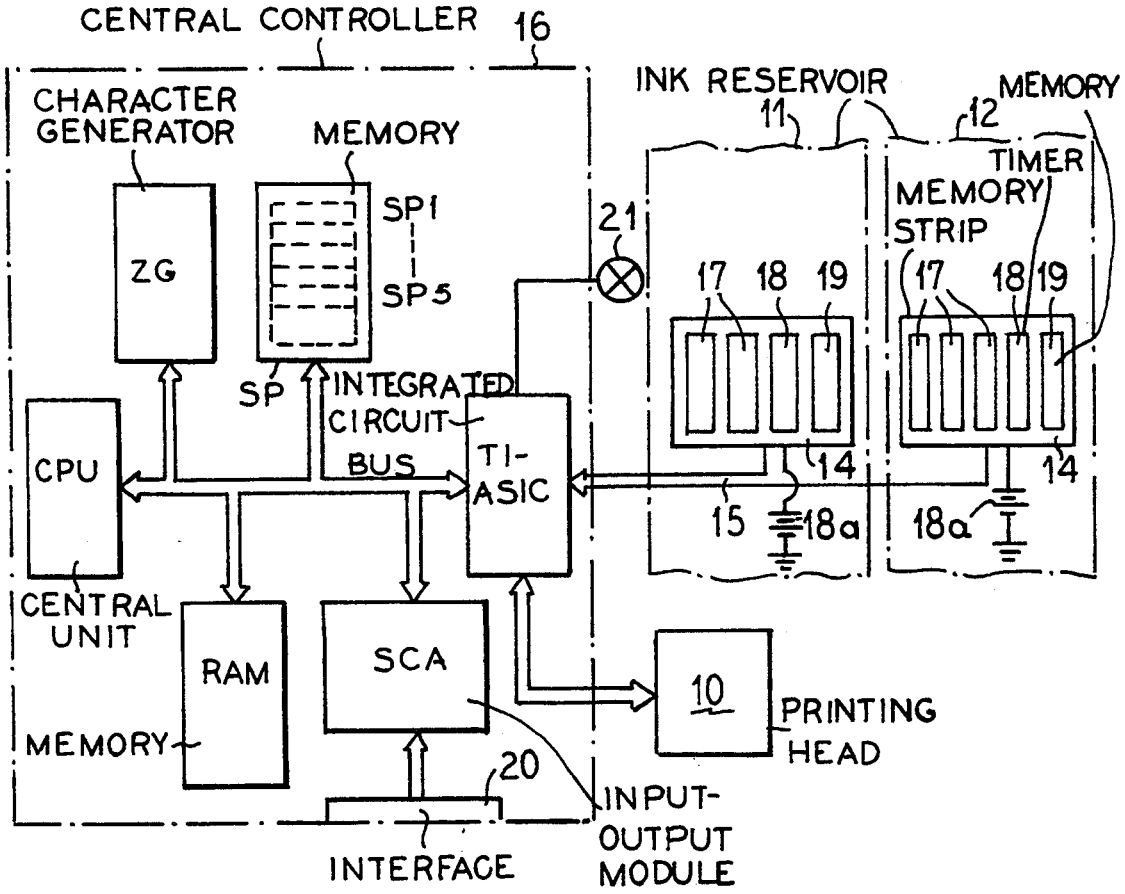

ARRANGEMENT FOR PRINTER EQUIPMENT FOR MONITORING RESERVOIRS THAT CONTAIN PRINTING MEDIUM

Various printing principles are employed in office printing equipment, whether they are text systems or simple printing systems that work in combination with communication terminal equipment. These printing principles, for example, are ink printing, thermal transfer printing, needle printing or type printing with type wheels and electrophotographic printing. What all of these principles have in common is that a printing medium.. contained in reservoirs is applied character-dependent onto a recording medium. The reservoirs—whether they are containers with writing fluid, inked ribbon cassettes or toner containers—are usually interchangeably secured in mounts of the printing equipment. They can be fashioned as throw-away containers that are filled in the factory an that are replaced as a unit after the consumption of the printing medium.

Such reservoirs for ink printer equipment are disclosed, for example, by German Patent 26 10 518 inked ribbon cassettes are disclosed by German Patent 32 14 548.

In order to guarantee a reliable printer operation, it is standard to monitor the supply of printing medium in the reservoirs. This monitoring is particularly required in ink printer equipment wherein the write head is composed of a mosaic write head which a plurality of writing nozzles are arranged. Due to the contraction events occurring in these writing nozzles during the writing mode, such a write head automatically supplies itself with writing fluid from an ink reservoir. When air penetrates into the writing nozzles, then special rinsing procedures are required in order to eliminate the air. Such devices for monitoring the ink supply in ink printing equipment are disclosed, for example, by German Patent 26 17 730.

DE-A1-3 405 164 discloses an arrangement for ink printing equipment wherein an ink reservoir is provided for the acceptance of printer ink; the reservoir can comprise an electronic memory means or a coding in which status data of the printer ink relevant to the printer operation are unerasable stored. These data stored in a ROM or as coding (color marking) can be registered trademarks of the manufacture or data about the type of ink employed.

The data are input once when the ink reservoir is manufactured and are then interrogated upon insertion into the printer. Given lack of coincidence of the data with data stored in a memory, printing is suppressed.

Ink printer equipment continue to be especially sensitive in view of the composition of the ink fluid employed. An inked that is not matched to the ink printing system may lead to a destruction of the printing head. For this reason, it is necessary to prevent used ink reservoirs that are refilled in uncontrolled fashion, for example by outside manufacturers with ink having an unknown composition, from being reused.

The same is also true of inked ribbon cassettes of any type; here, too, an uncontrolled reuse of refilled ink ribbon cassettes with inked ribbons wherein the specification of the inked ribbon is nc, t observed, for example with respect to thickness and layer structure, can lead to disruptions of the printing operation.

Printer or copier equipment working according to the principle of electrophotography are especially sensitive to the composition of the printing medium, a charge image being inked in these equipment with, for example, the assistance of a developer mix composed of carrier particles and toner particles. The inked charge image is transferred onto paper in a transfer printing station and is fixed in a fixing station. Toner that must be supplied from reservoirs of the developer station is constantly consumed when developing. Replaceable toner reservoirs are provided particularly given low-performance electrophotographic printers such as, for example, office printers. When toner having an incorrect composition is then supplied, a considerable deterioration of the printer operation can arise.

In this respect, what is meant below by printing equipment are all types of printing equipment including copier devices wherein a printing medium is applied character-dependent onto a recording medium.

It is therefore an object of the invention to offer an arrangement for printing equipment with which, first, it is possible to acquire the supply cf printing medium in a simple way and with which, on the other hand, it is possible to prevent an unauthorized reuse of used reservoirs or, respectively, to recognize refilled reservoirs.

In an arrangement of the species initially cited, this object is achieved by printing equipment that includes:

a reservoir for the acceptance of a printing medium, whereby the reservoir comprises an electronic memory means wherein status data of the printing medium relevant to the printing operation are stored, means for acquiring a current fill status of the reservoir and for writing a memory value corresponding to the current fill status into the electronic memory means, means for acquiring the memory value of the electronic memory means corresponding to a minimum supply of printing medium and for triggering an alarm signal and/or for blocking the printing operation, and means for suppressing the writeability of the electronic memory means after the memory value corresponding to the minimum supply of printing medium has been reached.

Advantageous embodiments of the invention provide that information about the service life of the printing medium are stored as status data. Furthermore, the memory means is fashioned as a recordable, non-volatile data store. In the preferred embodiments, the memory means comprises a counter means that is fashioned such that, proceeding from a preset basic counter reading corresponding to the filled condition of the reservoir, this counter reading is irreversibly modified in accord with the consumption of printing medium. Preferably, the memory means contains a timer whose basic setting can be preset and whose counter reading is irreversibly modified in accord with the current service life of the printing medium proceeding from the basic setting.

Other advantages are achieved when the memory means comprises an energy supply independent of the remaining printing equipment. The present invention finds particular utility when the reservoir is fashioned as an ink reservoir for an ink printer equipment, or when the reservoir is fashioned as a toner reservoir for a printer or copier means, or the reservoir is fashioned as an inked ribbon cassette. The present invention also provides that the memory means comprises a read-only memory for the acceptance of a code that identifies the reservoir and can be detected by the evaluation arrangement.

According to the invention, an electronic memory means in the form of an integrated circuit (chip) is allocated to a reservoir for printing equipment, information about the current fill status of the reservoir or other status data of the printing medium that are relevant for the printer operation and that can be called in via a recognition arrangement being stored in this electronic memory means. These status data, for example, can be information about the expiration date of the printing medium.

It becomes possible in a simple way on the basis of this arrangement to acquire the fill status of the reservoir during the printer operation. A downward transgression of a minimum supply of printing medium can be recognized in time. When the end of the supply is reached or when a minimum supply is downwardly transgressed, an alarm signal is triggered via the control arrangement of the printing equipment and is displayed on a display and it is possible to block the printer operation.

In that the electronic memory means in the form of an integrated circuit is constructed such that the electronic memory means cannot be reprogrammed after the end of the supply is reached, an inadmissible reuse of used reservoirs is reliably prevented or, respectively, refilled reservoirs can be unambiguously recognized.

In an advantageous embodiment of the invention, the electronic memory means contains a timer whose basic setting can be preset and whose counter reading is irreversibly modified in accord with the current service life of the printing agent proceeding from the basis setting. Damage to the printing equipment due, for example, to superannuated writing fluid or toner is thus reliably prevented.

Figure 2:
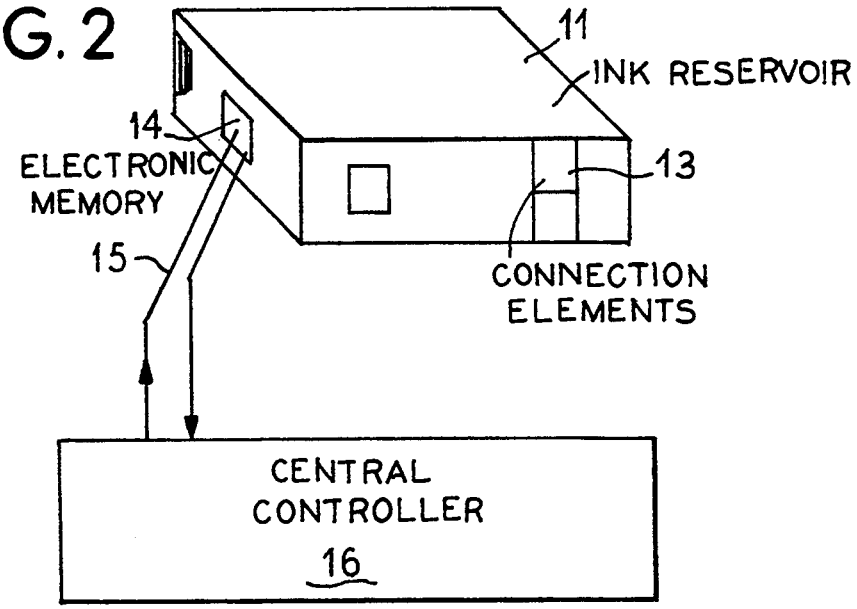

One embodiment of the invention is shown in the drawings and shall be set forth in greater detail below by way of example. Shown are:

FIG. 1 a block circuit diagram of the arrangement of the invention in a multi-color ink printing equipment; and FIG. 2 a schematic illustration of the structural format and arrangement for single-color operation.

In an ink printing equipment not shown in detail here, an ink mosaic printing head 10 is moved line-by-line along a recording medium during printing mode with the assistance of a motor means. The ink mosaic printer head is a matter of a multi-color ink mosaic printer head that operates, for example, according the bubble principle and that is supplied with writing fluid from two ink reservoirs 11 and 12 via an ink supply system. The ink reservoirs 11 and 12 can form a structural unit with the ink printer head or, on the other hand, they are stationarily arranged and are connected to the ink mosaic printer head 10 via a flexible conduit. The ink reservoir 11, which 10 corresponds in terms of its structural format to the ink reservoir shown in FIG. 2, thereby contains two flexible supply blisters for the acceptance of ink fluid, these blisters being connected via corresponding connection elements 13 to the supply system for the nozzles elements of the printer head. The storage blisters of the ink reservoir 11 are filled with black ink. In multi-color ink printer equipment, a further ink reservoir 12 that comprises three storage blisters that are filled with chromatic inks (magenta, cyan, yellow) is arranged above the ink reservoir 11. In exclusive black-white operation, a supply of the ink printer head 11 ensues only from the ink reservoir 11; ink is taken from the ink reservoir 12 only given chromatic operation.

An electronic memory 14 in the form of an integrated circuit (chip) is connected to the ink reservoirs 11, 12, for example by gluing or sealing, this integrated circuit potentially having a structure as employed, for example, in what are referred to as telephone cards wherein the charges are debited by bit-by-bit erasure of a memory strip contained in the chip card after the card is inserted into a public telephone. Via latchable terminal elements and a line 15 not shown here, the electronic memory 14 is connected to the central controller 16 of the ink printing equipment.

Each of the chips 14 connected to the ink reservoirs serves the purpose of storing the current fill status of the ink storage blisters of the respective ink reservoir in a memory area. To this end, each chip contains a memory strip 17 for every contained storage blister and this memory strip 10 for example, can also be fashioned as an electronic counter and the counter reading thereof or, respectively, occupancy thereof corresponding to the fill status of the allocated storage blister. The ink reservoir 11 comprising two storage blisters thus contains two memory strips 17; the ink reservoir 12 having three storage blisters contains three memory strips 17. The function of these memory strips or counters shall be set forth later. What are referred to as timers 18 are provided in addition to these memory strips 17. The timers 18 can likewise be fashioned as electronic counters. The timers is contain information about the expiration date cf the ink fluid. They are activated upon first-time introduction of the ink reservoir or, on the other hand, are already activated upon production, i.e. they being to run or, respectively, count up beginning with this time, whereby their counter reading corresponds to information about the storage time of the ink fluid. The timers are an option and they can be supplied with ink in network-independent fashion from an energy source a (voltage source 18*a* as shown in FIG. 1) that is integrated in the chip 14.

A read-only memory 19 for the acceptance of a code identifying the ink reservoir is also situated in the chips. This code is burned into the read-only memory when the ink reservoir is manufactured. Its content is checked after the ink reservoir is built into the ink printing equipment. The printer operation is enabled by the central controller 16 only after a positive check. The read-only memory is thereby fashioned as a memory whose coding can no longer be modified after the initial programming. The 10 code can thereby represent information about the type and the content of the ink reservoir, the manufacturing date thereof and expiration date, etc. When latching the ink reservoir in the holding mechanism of the printing equipment, this code is then checked by the central controller 16.

The central controller 16 is microprocessor-controlled and contains, for example, a microprocessor 80199 as central unit CPU. A character generator ZG in the form of a read-only memory that contains character shapes that can be generated with the assistance of mosaic printing is connected to the central unit via a data bus system BUS. A writeable, non-volatile memory (EE-PROM) SP that retains its memory content when the power supply is switched off is also connected to the data bus system BUS. Among other things, the memory SP serves as an intermediate memory and contains a plurality of memory areas SP1 through SP5 corresponding in number to the number of memory strips 17, these memory areas collaborating with the memory strips 17 in a way to be set forth later. The memory SP can also be fashioned as a program memory for the control program of the printer equipment.

An input-output module SCA is also coupled to the BUS system. What is thereby involved is a universal module standard in a printer controller that implements the communication of the printer equipment with the interface 20 at the data input of the printer equipment. This input-output module SCA also has the job of a converter for converting parallel data into serial data.

A further memory RAM that is likewise connected via the BUS system to the input and output module SCA serves as an intermediate memory for the data incoming via the interface 20 before they are after-processed in the printer controller 16.

The actual communication between the central controller 16, the ink head 10 and the electronic memories 14 ensues via a module referenced TI-ASIC (application specific integrated circuit). It contains a corresponding logic structure in order to accept the drive data for the ink mosaic printer head 10 in parallel from the BUS of the central controller 16 and to convert them into drive signals for the individual nozzles of the head 10.

The overall arrangement thereby operates according to the following principle:

The quantity of ink ejected during operation of ink printer equipment can be acquired by counting the individual droplets ejected. Every droplet thereby has a defined, constant volume, so that how many droplets can be generated, for example, with the content of a storage blister of the ink reservoir is known. The droplets of every color ejected by the ink mosaic printer head are thereby acquired by the acquisition arrangement of the central controller 26 during the printer operation and the information about the fill status of the ink reservoirs stored in the electronic memory means 14 is modified dependent on the identified consumption. This adaptation, for example, can ensue in that the memory strips 17 that are initially filled are erased bit-by-bit in accord with the consumption.

THE FUNCTION OF THE ARRANGEMENT IN DETAIL

The chip is activated during manufacture of the ink reservoir when the electronic memory element (chip 14) is inserted into the ink reservoir. The timer 18 arranged in the chip 14 that, for example, can be supplied by a network-independent energy source 183, comprises a basic setting of a counter whose counter reading corresponds to the allowable storage time of the ink fluid. This timer 18 is activated when the ink reservoir is manufactured and when it is joined to the electronic memory element 14. When the timer has run down, a counter reading that corresponds to the information "end of ink"is adjacent at the contacts at the container surface i.e. at the line 15. This information is queried via the TI-ASIC module and an alarm means fashioned, for example, in the form of a lamp 21 is activated at the printing equipment. Simultaneously, initialization of printer operation is suppressed. However, it is also possible to provide a separate warning lamp or a separate display means that immediately indicates when the expiration date of the ink reservoir has been passed.

Upon initial insertion of the ink reservoir 12 into the ink printing equipment, the basic setting of the timer in the chip 14 is set to the time the ink fluid is introduced into the device. Given preceding, correspondingly long storing of the ink reservoirs, this introduction time can be lower than the basic setting. After the timer has run down—as already set forth—, "end of ink" is indicated via the alarm lamp 21 or via a corresponding display.

In the printing operation, the TI-ASIC module acquires the drive pulses for the individual nozzles of the ink mosaic printer head 10 and, thus, the number of individual, ejected droplets. The memory areas SP1 through SP5 fashioned as counters are activated via the software. The counters SPI throuqh SP5 are allocated to the individual ink blisters and thus, to the different printing inks. The counters are circulating counters that return to their basic setting when a defined counter reading is reached and begin to count anew. The counter capacity thereby corresponds to a defined number of, for example, 10,000 ink droplets. When resetting the counters, i.e. after the respective countdown of 10,000 ejected ink droplets of every type (color) of ink, the corresponding, allocated memory strip 17 of the electronic memory 14 at the reservoir is erased bit-by-bit via the module TI-ASIC. This means that the counter reading of a counter means of the chip 14 allocated to the memory strip 17 is modified according to the consumption of ink fluid preceding from a preset basic counter reading corresponding to the filled condition of the reservoir. This modification is irreversible, i.e. a reprogramming is not possible after the run-down of the counter or after the bits on the data strip 17 have been "debited". Both the counters in the device SP1 through SP5 as well as the counters in the chip 14 (data strip 17) are permanent, i.e. they are not reset when the power supply of the ink printer equipment is interrupted.

The amount of ink consumed during cleaning procedures is likewise taken into consideration in the noting of the number of ejected ink droplets.

When the counter reading in the chip 14 reaches a counter reading corresponding, for example, to a minimum supply (fully debited bit strip 17), this counter reading is acquired by the module in TI-ASIC and an alarm means in the form, for example, of the 10 lamp 21 is activated. This can occur, for example, in that a flashing signal is output via the lamp 21. The printing operation can be maintained for a certain time with the minimum ink supply contained in the ink reservoirs at this point in time. After a counter reading that corresponds to the end of ink, i.e. To the complete consumption of ink of the ink supply is reached (taking a safety margin into consideration), further printer operation is suppressed via the module in TI-ASIC and this end of ink conditions is then displayed via the lamp 21 that, for example, can then be switched to continuously lit.

As already set forth, the electronic memories are fashioned such that a renewed programming is not possible. When the used ink reservoir is refilled with ink in an inadmissible way, then the electronic memory 14 remains in its status corresponding to the "end of ink". When such a refilled ink reservoir is introduced into the ink printing equipment, the end of ink condition is therefore displayed via the module in TI-ASIC and the alarm means 21 and printer operation is prevented.

The arrangement of the invention has been set forth above with reference to a reservoir for an ink printing equipment. However, it can also be applied to inked ribbon cassettes of any type, whether they are inked ribbon cassettes having thermo inked ribbons for thermo transfer printing equipment or inked ribbons for striking printers. In inked ribbon cassettes—analogous to ink reservoirs—a chip 14 (electronic memory means)

having the corresponding, described structure is secured to the inked ribbon cassette in a way not shown here. During the printing operation, a continuous conveying monitoring of the inked ribbon ensues, for example by a means corresponding to German Patent 32 14 548. Dependent on the number of individual printed points in mosaic printer equipment or on the printed number of characters in type printing equipment, the inked ribbon is moved in the inked ribbon cassette from the supply reel to the take-up reel. With the arrangement of the invention, the consumption of the inked ribbon is acquired by the electronics of the printer equipment via the drive pulses of the printer head and this is communicated to the electronic memory means at the inked ribbon cassettes. The chip 14 (electronic memory means) counts the consumption until the inked ribbon supply has been exhausted to such an extent that the inked ribbon cassette must be replaced. The used-up status of the inked ribbon cassette can be interrogated by the central controller 16 at any time during printer operation. When the counter reading in the chip 14 indicates the used-up condition of the inked ribbon cassette, a further printer output is interrupted by the printer electronics in the way set forth and a corresponding malfunction alarm is set.

The described arrangement can also be employed in electrophotographic or magnetic printer or copier equipment. Modern printer or copier equipment that are designed for employment in the office have replaceable toner reservoirs that are replaced as a unit when the toner supply is exhausted (DE-A-GM 87 05 870). A replacement of the entire developer station including the photoconductive drum is often also provided. Here, too, an electronic memory means can be arranged at the container in the way set forth, this electronic memory means collaborating with the central controller of the electrophotographic printer or copier device. Since it is known how much toner is needed on average for inking a charge image, the toner consumption can be calculated, for example, from the number of revolutions of the charge image carrier or from the measurement of the degree of inking of the characters via an optical sensor. The electronic memory means (chip) counts the consumption of toner until the toner supply is exhausted to such an extent that the toner supply cassette must be replaced. The used-up condition of the toner supply cassette can be interrogated by the central controller at any time during printer operation. When the counter reading in the chip indicates the used-up condition of the supply cassette, the central controller suppresses further printing operation and a corresponding display is activated, for example via a display.

Although other modifications and changes may be suggested by those skilled in the art, it is the intention of the inventors to embody within the patent warranted hereon all changes and modifications as reasonably and properly come within the scope of their contribution to the art.

We claim:

1. An arrangement for printing equipment, comprising:

a) a reservoir means for accepting a printing medium, said reservoir comprises an electronic memory means for storing status data of the printing medium relevant to a printing operation, b) means for acquiring a current fill status of said reservoir means and for writing a memory value corresponding to the current fill status into said electronic memory means, c) means for acquiring the memory value of said electronic memory means corresponding to a minimum supply of printing medium and for at least one of triggering an alarm signal and blocking a printing operation, and said electronic memory means being irreversibly modified by said means for writing a memory value so that writeability of said electronic memory means is suppressed after the memory value corresponding to the minimum supply of printing medium as been reached;

e) timer means for counting down time intervals from an initial filling of the printing medium into said reservoir means to an expiration of a predetermined service life; and f) means for blocking printing operation when said timer means indicates an expiration of said predetermined service life.

2. An arrangement according to claim 1, further comprising: means for storing information about service life of the printing medium as status data.

3. An arrangement according to claim 1, wherein said electronic memory means comprises a recordable, nonvolatile data store.

4. An arrangement according to claim 3, wherein said electronic memory means comprises a counter having means for irreversibly modifying a reading of said counter in accordance with consumption of the printing medium proceeding from a preset basic counter reading corresponding to a filled condition of the reservoir means.

5. An arrangement according to claim 1, wherein said electronic memory means comprises an energy supply independent of remaining printing equipment.

6. An arrangement according to claim 1, wherein said reservoir means comprises an ink reservoir for an ink printer equipment.

7. An arrangement according to claim 1, wherein said reservoir means comprises a toner reservoir for a printer or copier means.

8. An arrangement according to claim 1, wherein said reservoir means comprises an inked ribbon cassette.

9. An arrangement according to claim 1, wherein said memory means comprises a read-only memory means for accepting a code that identifies said reservoir means and can be detected by an evaluation arrangement.

10. An arrangement for printing equipment, comprising:

a) a reservoir means for accepting a printing medium, said reservoir comprises an electronic memory means for storing status data of the printing medium relevant to a printing operation, b) means for acquiring a current fill status of said reservoir means and for writing a memory value corresponding to the current fill status into said electronic memory means, c) means for acquiring the memory value of said electronic memory means corresponding to a minimum supply of printing medium and for at least one of triggering an alarm signal and blocking a printing operation, d) said electronic memory means being irreversibly modified by said means for writing a memory value so that writeability of said electronic memory means is suppressed after the memory value corresponding to the minimum supply of printing medium has been reached, e) means for storing information about service life of the printing medium as status data, said memory means comprising a timer having a preset basic setting and means for irreversibly modifying a counter reading of said timer in accord with current service life of the printing medium proceeding from the basic setting.

* * * * *